US005573900A

United States Patent [19]

Kawanishi et al.

[11] Patent Number: 5,573,900

[45] Date of Patent: Nov. 12, 1996

[54] DISPERSION METHOD OF HYDROPHOBIC, PHOTOGRAPHICALLY USEFUL COMPOUND

[75] Inventors: Naoyuki Kawanishi; Kazuhiko Fujiwara; Tomokazu Yasuda, all of Kanagawa, Japan

[73] Assignee: Fuji Photo Film Co., Ltd., Kanagawa, Japan

[21] Appl. No.: 445,293

[22] Filed: May 19, 1995

[30] Foreign Application Priority Data

May 20, 1994 [JP] Japan ..... 6-107060

[51] Int. Cl.[6] ..... G03C 1/38

[52] U.S. Cl. ..... 430/546; 430/610; 430/631; 430/512; 430/955

[58] Field of Search ..... 430/546, 631, 430/610, 512, 955

[56] References Cited

U.S. PATENT DOCUMENTS

| | | | |
|---|---|---|---|
| 2,870,012 | 1/1959 | Godowsky et al. . | |
| 4,211,836 | 7/1980 | Yoneyama et al. . | |
| 4,220,711 | 9/1980 | Nakamura et al. | 430/546 |

FOREIGN PATENT DOCUMENTS

| | | |
|---|---|---|
| 0361322 | 4/1990 | European Pat. Off. . |
| 0639790 | 2/1995 | European Pat. Off. . |
| 56-3307448 | 12/1988 | Japan . |
| 1193349 | 5/1970 | United Kingdom . |
| 1560378 | 2/1980 | United Kingdom . |

*Primary Examiner*—Thorl Chea
*Attorney, Agent, or Firm*—Sughrue, Mion, Zinn, Macpeak & Seas

[57] ABSTRACT

A method for dispersing a water-insoluble phase containing a hydrophobic, photographically useful compound in water or a hydrophilic colloid composition using an anionic surface active agent is disclosed, which comprises dispersing the hydrophobic, photographically useful compound by using an anionic surface active agent having a hydrophobic group and a group represented by $—SO_3M$ or $—OSO_3M$ (where M represents a cation) and a specific phosphorus-containing surface active compound, or, adding the anionic surface active agent for dispersion, and after the completion of dispersion further adding the specific phosphorus-containing surface active compound. According to the dispersion method of the present invention, a dispersion favored with maintenance of fine particle performance at the dispersion and free of grain growth during aged storage or generation of coarse grains or precipitated crystals can be obtained.

10 Claims, No Drawings

DISPERSION METHOD OF HYDROPHOBIC, PHOTOGRAPHICALLY USEFUL COMPOUND

FIELD OF THE INVENTION

The present invention relates to a method for dispersing photographically useful compounds used in a silver halide photographic material, more specifically, to a method for stably dispersing hydrophobic, photographically useful compounds in water or in a hydrophilic colloid composition.

BACKGROUND OF THE INVENTION

A photographic material comprises on a support hydrophilic colloid layers containing hydrophobic, photographically useful compounds.

The hydrophobic, photographically useful compound includes, for example, coupler for forming image, colored coupler, development inhibitor-releasing coupler, discoloration inhibitor, antifoggant, ultraviolet absorbent, photographic dye and color mixing inhibitor. In general, the hydrophobic, photographically useful compound is incorporated into a silver halide photographic material by a method called the oil-protect method where the compound is dissolved in a high boiling point organic solvent and emulsified, a method where the compound is directly dispersed in the state of solid without any organic solvent, or a method where the hydrophobic, photographically useful compound is dissolved in an organic solvent miscible with water or in a basic aqueous solution and then precipitated and dispersed in water as fine particles as described in British Patent 1,193,349, RD No. 16468, U.S. Pat. No. 2,870,012 and European Patents 361,322 and 347,837.

In any of the above-described methods, the photographically useful compound must be dispersed as fine particles in a size less than 1 μm to increase the surface area per unit weight of dispersed solid so that the expensive compound can effectively be used. However, it cannot evade the general fate of colloid dispersions such that the aging stability of dispersion is worsened as the particle number and the interfacial area increase, which gives rise to deterioration not only in quality in view of photographic performance but also in coating quality due to comet accompanying generation of coarse grains or crystallization of hydrophobic compound.

These problematic phenomena are particularly outstanding during storage of the above-described dispersions and when gelatin is contained therein, they may be caused during either storage at a temperature lower than the gelation temperature of the aqueous gelatin solution or storage at a temperature higher than the melting point of the gel. Accordingly, the aging time under control may be restricted or in some cases, an uneconomical situation is brought about such that the dispersion containing defects has to be discarded.

SUMMARY OF THE INVENTION

The present invention is to solve the above-described problems encountered in conventional techniques and the object of the present invention is to provide a method capable of obtaining a dispersion prolonged maintenance of fine particle performance and free of particle growth during aged storage or generation of coarse particles or precipitated crystals.

As a result of intensive investigations, the present inventors have found that the above-described object can be achieved by:

(1) a method for dispersing a water-insoluble phase containing a hydrophobic, photographically useful compound in water or a hydrophilic colloid composition using an anionic surface active agent, which comprises dispersing the hydrophobic, photographically useful compound in the presence of an anionic surface active agent containing a hydrophobic group having from 8 to 30 carbon atoms and a group represented by $—SO_3M$ or $—OSO_3M$ (where M represents a cation capable of forming a salt with a sulfonic acid or a sulfuric acid) and a surface active compound represented by formula (I):

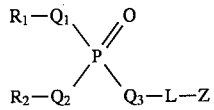

(I)

wherein $R_1$ represents an aliphatic group, an alicyclic compound group, an aromatic group or a heterocyclic ring, $R_2$ represents an aliphatic group, an alicyclic compound group, an aromatic group, a heterocyclic ring or a group represented by —L—Z, $Q_1$, $Q_2$ and $Q_3$ each represents a mere bond, an oxygen atom, a sulfur atom or a group represented by $—N(R_3)—$ or $—N(R_3)—CO—$ (where $R_3$ represents a hydrogen atom or a group represented by $R_2$), L represents a divalent linking group and Z represents an ionic group; and (2) a method for dispersing a water-insoluble phase containing a hydrophobic, photographically useful compound in water or a hydrophilic colloid composition using an anionic surface active agent, which comprises the steps of:

adding an anionic surface active agent containing a hydrophobic group having from 8 to 30 carbon atoms and a group represented by $—SO_3M$ or $—OSO_3M$ (where M represents a cation capable of forming a salt with a sulfonic acid or a sulfuric acid) to either of the water-insoluble phase or the water or hydrophilic colloid composition;

mixing and dispersing the hydrophobic, photographically useful compound therein; and then adding the surface active compound represented by formula (I) described above to the dispersed system.

DETAILED DESCRIPTION OF THE INVENTION

The present invention will be described below in detail.

The present invention is effective in dispersing a hydrophobic, photographically useful compound (hereinafter, sometimes referred to as a "hydrophobic compound" or a "photographic compound") as fine particles. More specifically, the effect of the present invention is conspicuous in obtaining dispersions having an average particle size of less than 1 μm and a dispersed phase volume ratio of 10% or more. In the preparation of such a dispersion, the surface active compound added must adsorb to the surface of the dispersed fine particles without delay so as to prevent coagulation of particles resulting from an increase in the surface area and an increase in the particle number. Considering the kinetic properties of the molecule, namely, the dispersion speed and the orientation rate, the surface active agent with a low molecular weight better adsorbs in compliance with the abrupt increase in the interfacial area.

However, to be high in kinetic properties of the molecule turns out to be low in stability against disturbances such as agitation or heating during storage of the dispersion after preparation, and the stability against transport operation, for example, by means of a pump or thermal operation such as cooling or heating is frequently not satisfied. In order to achieve satisfactory stability, a polymer surface active agent is sometimes used, but as pointed out in U.S. Pat. No. 5,013,640, if a polymer is added to a thick dispersion system, the viscosity is disadvantageously increased to an extreme extent.

According to the present invention, a specific surface active compound represented by the above-described formula (I) (hereinafter referred to as "Compound (I)") and a low molecular weight surface active agent having a sulfonic acid group or a sulfuric acid group (hereinafter referred to as an "anionic surface active agent") are used in combination thereby, a dispersion not only stable in the dispersion operation but also free of change in particle size or generation of coarse particles even in a long-term storage involving transportation or thermal operation can be provided.

In the present invention, the anionic surface active agent is used to produce fine particles in the preparation of dispersion. On the other hand, Compound (I) is used to form a firm adsorption film after the preparation of dispersion particles to protect the particles against agglomeration. Accordingly, in practicing the method of the present invention, these two surface active agents are usually added simultaneously at the preparation of dispersion but depending on the combination of Compound (I) and the anionic surface active agent, respective characteristics may not be fully achieved. In such a case, the object of the present invention can be achieved by adding Compound (I) after the preparation of dispersion. Compound (I) may be added at any time between after the preparation of dispersion and before the use of the dispersion but Compound (I) is preferably added before it is mixed with a silver halide emulsion, or more preferably immediately after the preparation of dispersion where the dispersion is not substantially aged.

In formula (I), preferred examples of the aliphatic group represented by $R_1$ include a linear or branched unsubstituted alkyl group having from 1 to 40 carbon atoms (e.g., methyl, ethyl, n-propyl, iso-propyl, n-butyl, sec-butyl, tert-butyl, n-amyl, tert-amyl, n-hexyl, n-heptyl, n-octyl, tert-octyl, 2-ethylhexyl, n-nonyl, 1,1,3-trimethyl-hexyl, n-decyl, n-dodecyl, cetyl, hexadecyl, 2-hexyldecyl, octadecyl, eicosyl, 2-octyldodecyl, docosyl, tetracosyl, 2-decyltetradecyl, tricosyl), a linear or branched substituted alkyl group having from 1 to 40 carbon atoms (examples of the substituent including an alkoxyl group, an aryl group, a halogen atom, a carbon ester group, a carbon amide group, a carbamoyl group, an oxycarbonyl group and a phosphoric ester group) (e.g., benzyl, β-phenethyl, 2-methoxyethyl, 4-phenylbutyl, 4-acetoxyethyl, 6-phenoxyhexyl, 12-phenyldodecyl, 18-phenyloctadecyl, heptadecylfluorooctyl, 12-(p-chlorophenyl)dodecyl, 2-(diphenyl phosphate)ethyl), a linear or branched unsubstituted alkenyl group having from 2 to 40 carbon atoms (e.g., vinyl, allyl, 3-butenyl, 2-methyl-2-butenyl, 4-pentenyl, 3-pentenyl, 3-methyl-3-pentenyl, 5-hexenyl, 4-hexenyl, 3-hexenyl, 2-hexenyl, 7-octenyl, 9-decenyl, oleyl, linoleyl, linolenyl), a linear or branched substituted alkenyl group having from 2 to 40 carbon atoms (e.g., 2-phenylvinyl, 4-acetyl-2-butenyl, 13-methoxy-9-octadecenyl, 9,10-dibromo-12-octadecenyl), a linear or branched unsubstituted alkynyl group having from 2 to 40 carbon atoms (e.g., acetylene, propargyl, 3-butynyl, 4-pentynyl, 5-hexynyl, 4-hexynyl, 3-hexynyl, 2-hexynyl) and a linear or branched substituted alkynyl group having from 2 to 40 carbon atoms (examples of the substituent including an alkoxy group and an aryl group) (e.g., 2-phenylacetylene, 3-phenylpropargyl).

Preferred examples of the alicyclic compound group include a substituted or unsubstituted cycloalkyl group having from 3 to 40 carbon atoms (e.g., cyclopropyl, cyclohexyl, 2,6-dimethylcyclohexyl, 4-tert-butylcyclohexyl, 4-phenylcyclohexyl, 3-methoxycyclohexyl, cycloheptyl) and a substituted or unsubstituted cycloalkenyl group having from 4 to 40 carbon atoms (e.g., 1-cyclohexenyl, 2-cyclohexenyl, 3-cyclohexenyl, 2,6-dimethyl-3-cyclohexenyl, 4-tert-butyl-2-cyclohexenyl, 2-cycloheptenyl, 3-methyl-3-cycloheptenyl).

Preferred examples of the aromatic group include a substituted or unsubstituted aryl group having from 6 to 50 carbon atoms (examples of the substituent including an alkyl group, an alkoxyl group, an aryl group and a halogen atom) (e.g., phenyl, 1-naphthyl, 2-naphthyl, anthranyl, o-cresyl, m-cresyl, p-cresyl, p-ethylphenyl, p-tert-butylphenyl, 3,5-di-tert-butylphenyl, p-n-amylphenyl, p-tert-amylphenyl, 2,6-dimethyl-4-tert-butylphenyl, p-cyclohexylphenyl, octylphenyl, p-tert-octylphenyl, nonylphenyl, p-n-dodecylphenyl, m-methoxyphenyl, p-butoxyphenyl, m-octyloxyphenyl, biphenyl, m-chlorophenyl, pentachlorophenyl, 2-(5-methylnaphthyl)).

Preferred examples of the heterocyclic ring include a substituted or unsubstituted cyclic ether having from 4 to 40 carbon atoms (e.g., furyl, 4-butyl-3-furyl, pyranyl, 5-octyl-2H-pyran-3-yl, isobenzofuranyl, chromenyl) and a substituted or unsubstituted nitrogen-containing ring having from 4 to 40 carbon atoms (e.g., 2H-pyrrolyl, pyrrolyl, imidazolyl, pyrazolyl, indolizinyl, morpholyl).

Among these, more preferred are a linear, cyclic or branched unsubstituted alkyl group having from 1 to 24 carbon atoms (e.g., methyl, ethyl, n-propyl, n-butyl, n-amyl, n-hexyl, cyclohexyl, n-heptyl, n-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl), a linear, cyclic or branched substituted alkyl group having from 1 to 24 carbon atoms exclusive of carbon atoms of the substituent (e.g., 6-phenoxyhexyl, 12-phenyldodecyl, 18-phenyloctadecyl, heptadecylfluorooctyl, 12-(p-chlorophenyl)dodecyl, 4-tert-butylcyclohexyl), a linear, cyclic or branched unsubstituted alkenyl group having from 2 to 24 carbon atoms (e.g., vinyl, allyl, 2-methyl-2-butenyl, 4-pentenyl, 5-hexenyl, 3-hexenyl, 3-cyclohexenyl, 7-octenyl, 9-decenyl, oleyl, linoleyl, linolenyl), a linear, cyclic or branched substituted alkenyl group having from 2 to 24 carbon atoms (e.g., 2-phenylvinyl, 9,10-dibromo-12-octadecenyl) and a substituted or unsubstituted aryl group having from 6 to 30 carbon atoms (e.g., phenyl, 1-naphthyl, 2-naphthyl, p-cresyl, p-ethylphenyl, p-tert-butylphenyl, p-tert-amylphenyl, octylphenyl, p-tert-octylphenyl, nonylphenyl, p-n-dodecylphenyl, m-octyloxyphenyl, biphenyl).

$Q_1$, $Q_2$ and $Q_3$ each represents a group selected from a mere bond, an oxygen atom, a sulfur atom, —$N(R_3)$— and —$N(R_3)$—CO— (where $R_3$ represents a hydrogen atom or $R_2$ defined above and $R_3$ may be the same with or different from $R_2$). Among these, preferred are a mere bond, an oxygen atom and —$N(R_3)$—, and more preferred are those where at least-two of $Q_1$, $Q_2$ and $Q_3$ are an oxygen atom. The mere bond as used herein means that an element is not present.

L represents a divalent linking group and preferably a group represented by the following formula:

$$[Y_1-(J_1)]_p[Y_2-(J_2)]_q]_a[Y_3-(J_3)]_r]_b]_s$$

wherein $Y_1$, $Y_2$ and $Y_3$, which may be the same or different, each represents a substituted or unsubstituted alkylene group having from 1 to 40 carbon atoms and a substituted or unsubstituted arylene group having from 6 to 40 carbon atoms (examples of the substituent being the same as described in the definition for $R_1$). Preferred examples of the alkylene group include a methylene group, an ethylene group, a propylene group, a trimethylene group, a tetramethylene group, a pentamethylene group, a hexamethylene group, a 1,4-cyclohexylene group, an octamethylene group, a decamethylene group, 2-methoxy-1,3-propylene group and preferred examples of the arylene group include an o-phenylene group, a m-phenylene group, a p-phenylene group, a 3-chloro-1,4-phenylene group, a 1,4-naphthylene group and a 1,5-naphthylene group. Among these, more preferred are an ethylene group, a propylene group, a trimethylene group, a tetramethylene group, a pentamethylene group, a hexamethylene group, a 1,4-cyclohexylene group, an octamethylene group, a decamethylene group, a m-phenylene group and a p-phenylene group.

$J_1$, $J_2$ and $J_3$, which may be the same or different, each represents a divalent bond unit and preferred examples thereof include a mere bond, —O—, —S—, —CO—, —COO—, —OCO—, —CON($R_4$)— (where $R_4$ represents a hydrogen atom, an unsubstituted alkyl group having from 1 to 6 carbon atoms or a substituted alkyl group having from 1 to 6 carbon atoms exclusive of carbon atoms of the substituent (examples of the substituent including an aryl group, an alkoxyl group, a halogen atom)), —N($R_4$)CO— (where $R_4$ has the same meaning as above), —CON($R_4$)CO— (where $R_4$ has the same meaning as above), —N($R_4$)CON($R_5$)— (where $R_4$ and $R_5$, which may be the same or different, each has the same meaning as described for $R_4$ above), —OCON($R_4$)— (where $R_4$ has the same meaning as above), —N($R_4$)COO— (where $R_4$ has the same meaning as above), —$SO_2$—, —$SO_2$N($R_4$)— (where $R_4$ has the same meaning as above), —N($R_4$)$SO_2$— (where $R_4$ has the same meaning as above), —N($COR_4$)— (where $R_4$ has the same meaning as above) and —OP(=O)($OR_1$)O— (where $R_1$has the same meaning as above). Among these, more preferred are a mere bond, —O—, —S—, —CO—, —COO—, —OCO—, —CON($R_4$)— (where $R_4'$ represents a hydrogen atom, a methyl group, an ethyl group or a propyl group), —N($R_4'$)CO— (where $R_4'$ has the same meaning as above), —$SO_2$N($R_4'$)— (where $R_4'$ has the same meaning as above) and —N($R_4'$)$SO_2$— (where $R_4'$ has the same meaning as above).

p, q and r each represents 0 or an integer from 1 to 5, preferably 0 or an integer from 1 to 3 and more preferably 0 or 1.

s represent an integer from 1 to 10, preferably from 1 to 5, more preferably from 1 to 3.

a and b each represents 0 or an integer from 1 to 50, preferably 0 or an integer from 1 to 20 and more preferably 0 or an integer from 1 to 10.

Z is preferably a hydrophilic anionic, cationic or amphoteric ionic group and in view of photographic performance, more preferably an anionic group. Preferred examples of the anionic group include —COOM, —$SO_3$M, —$OSO_3$M, —PO(OM)$_2$, —OPO(OM)$_2$ (where M represents a counter ion, preferably an alkali metal ion (e.g., lithium ion, sodium ion, potassium ion), an alkaline earth metal ion (e.g., magnesium ion, calcium ion) or an ammonium ion, more preferably sodium ion or potassium ion). Preferred examples of the cationic group include —$NH_3^+$.$X^-$, —$NH_2(R_6)^+$.$X^-$, —$NH(R_6)_2^+$.$X^-$, —$N(R_6)_3^+$.$X^-$ (where $R_6$ represents an alkyl group having 1 to 3 carbon atoms (e.g., methyl, ethyl, 2-hydroxyethyl, n-propyl, iso-propyl), more preferably a methyl group or a 2-hydroxyethyl group).

X represents a counter anion, preferably a halogen ion (e.g., fluoride ion, chloride ion, bromide ion), a complex inorganic anion (e.g., hydroxide ion, sulfuric acid ion, nitric acid ion, phosphoric acid ion) or an organic compound ion (e.g., oxalic acid ion, formic acid ion, acetic acid ion propionic acid ion, methanesulfonic acid ion, p-toluenesulfonic acid ion), more preferably chloride ion, sulfuric acid ion, nitric acid ion or acetic acid ion.

Preferred examples of the amphoteric ionic group include those represented by the formula (II):

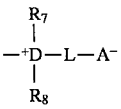

(II)

wherein D represents a nitrogen atom or a phosphorus atom, $R_7$ and $R_8$ each represents a hydrogen atom, an alkyl group having from 1 to 3 carbon atoms (e.g., methyl, ethyl, 2-hydroxyethyl, iso-propyl), preferably a methyl group and a 2-hydroxyethyl group, L is the same as the divalent linking group defined in formula (I) above, and $A^-$ represents an anionic group, preferably a group represented by —$COO^-$, —$SO_3^-$, —$OSO_3^-$, —PO($OR_9$)$O^-$ or —OPO($OR_9$)$O^-$ (where $R_9$ represents a hydrogen atom or an alkyl group having 1 to 3 carbon atoms, e.g., methyl, ethyl, 2-hydroxyethyl, iso-propyl).

$R_2$ is a monovalent group selected from the groups described for $R_1$ and the groups described for —L—Z; when $R_2$ is selected from the groups described for $R_1$, it may have the same structure with or different structure from that of $R_1$ present in the same molecule; and when $R_2$ is selected from the groups described for —L—Z, $R_2$ may have the same structure with or different structure from that of —L—Z present in the same molecule; and $R_2$ is more preferably selected from the groups described for $R_1$. The total number of carbon atoms present in $R_1$ and $R_2$is preferably from 6 to 80, more preferably from 8 to 50.

Any two or more groups described above for $R_1$, $R_2$ and L may be combined with each other to form a ring. In this case, the ring formed is not particularly limited but in view of stability of the ring structure, 4- to 7-membered rings, more preferably 5- and 6-membered rings are preferred.

Specific examples of preferred surface active compounds represented by formula (I) are set forth below but the present invention is by no means limited to these specific examples.

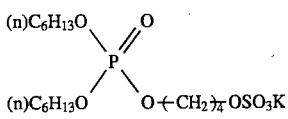

PW-1

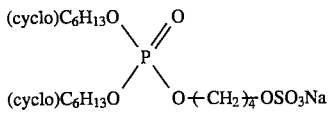

PW-2

-continued
PW-3
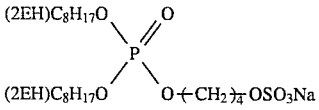
PW-4
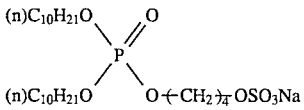
PW-5
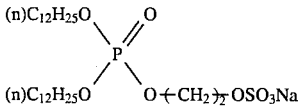
PW-6
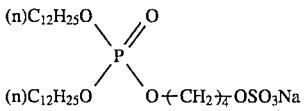
PW-7
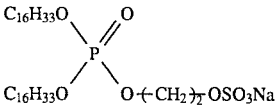
PW-8
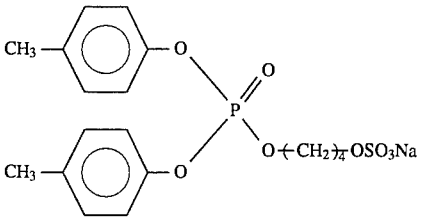
PW-9
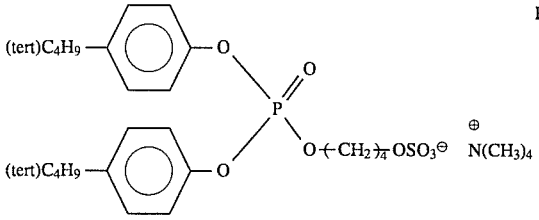
PW-10
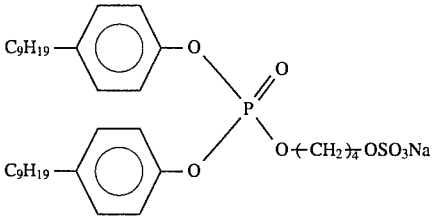
PW-11
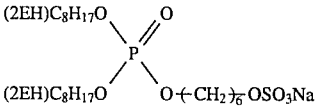
PW-12
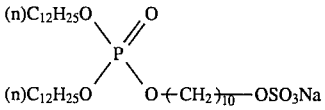
PW-13
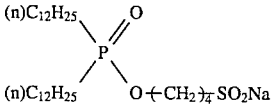
PW-14
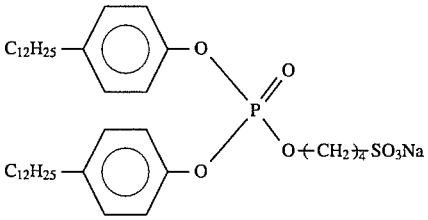
PW-15
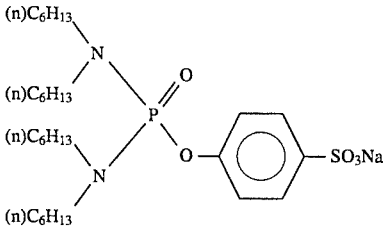
PW-16
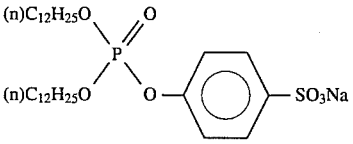
PW-17
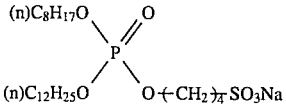
PW-18
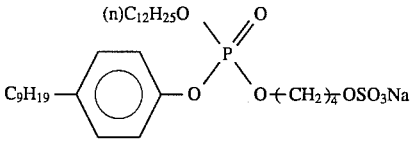
PW-19
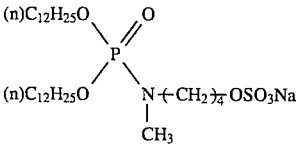
PW-20
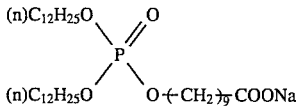

-continued
PW-21
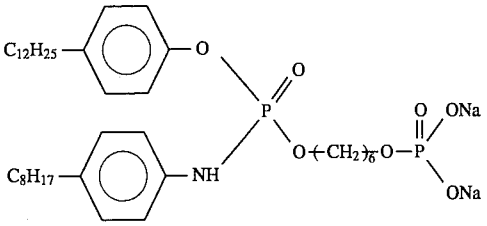
PW-22
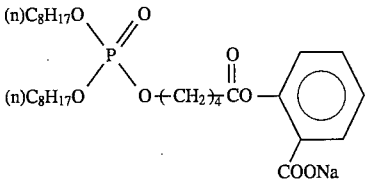
PW-23
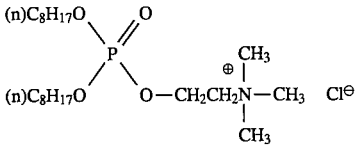
PW-24
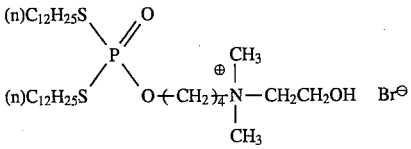
PW-25
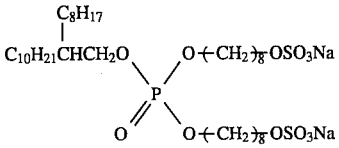
PW-26
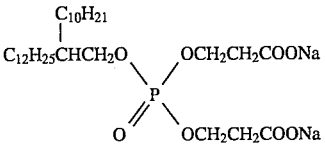
PW-27
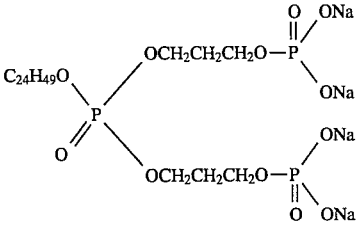
PW-28
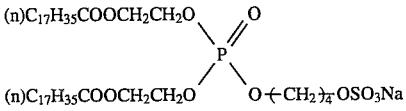
PW-29
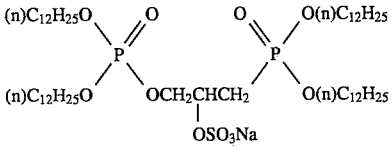
PW-30
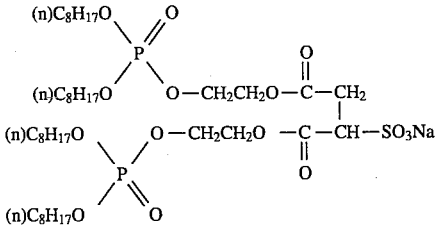
PW-31
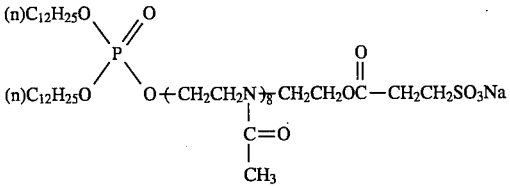
PW-32
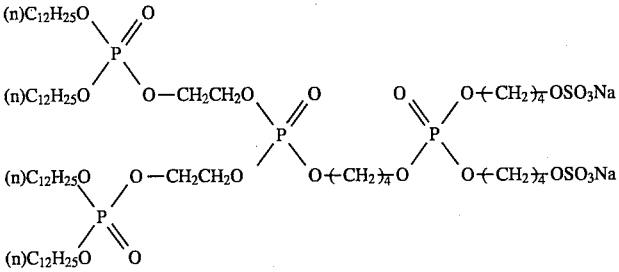
PW-33
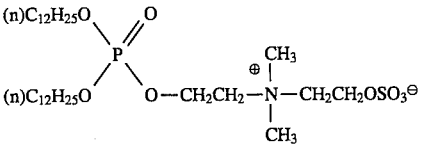
PW-34
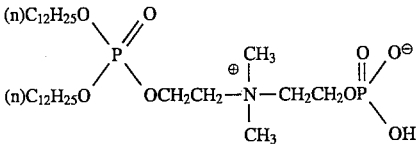

-continued

PW-35

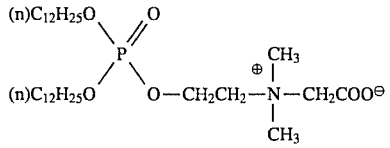

PW-36

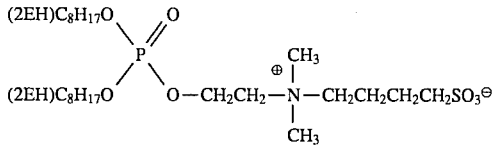

PW-37

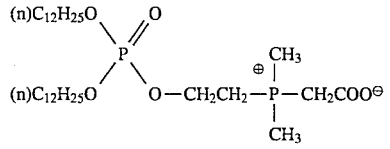

PW-38

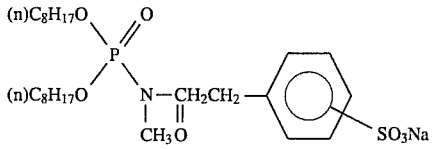

PW-39

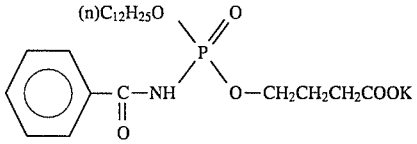

PW-40

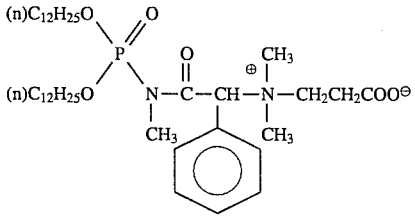

PW-41

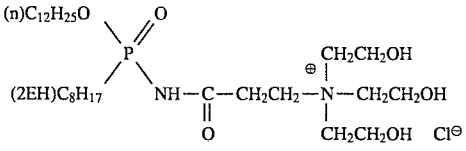

PW-42

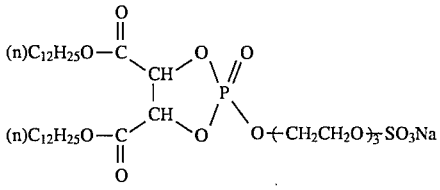

PW-43

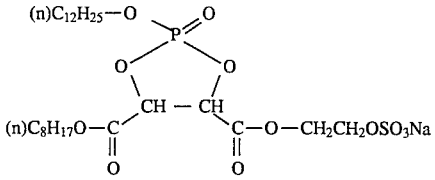

PW-44

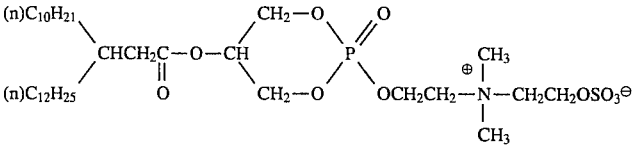

The surface active agent represented by formula (I) is added in an amount from 0.1 to 10.0 wt % based on the dispersoid (e.g., coupler, oil, solvent).

The anionic surface active agent is a compound containing a hydrophobic group having from 8 to 30 carbon atoms and —$SO_3M$ or —$OSO_3M$ (where M represents a cation capable of forming a salt with a sulfonic acid or a sulfuric acid, such as an alkali metal (e.g., sodium) or an alkaline earth metal) together in one molecule. The compounds of this kind are described in A. W. Perry, *Surface Active Agents* Interscience Publications Inc., New York. Specific examples of the above-described anionic surface active agent include the following compounds, but the present invention is by no means limited to these compounds.

| | |
|---|---|
| $C_{12}H_{25}OSO_3Na$ | (S-1) |
| $C_{14}H_{29}OSO_3Na$ | (S-2) |
| Turkey red oil | (S-3) |
| $C_{12}H_{25}CONHCH_2CH_2OSO_3Na$ | (S-4) |
| $C_{12}H_{25}SO_3Na$ | (S-5) |
| $C_{14}H_{29}SO_3Na$ | (S-6) |

-continued (S-7)

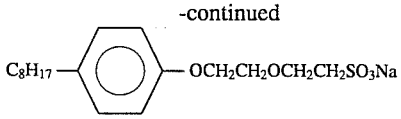

(S-8)

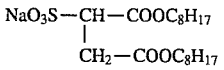

(S-9)

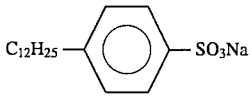

(S-10)

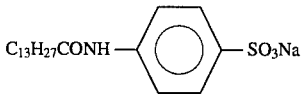

-continued (S-11)

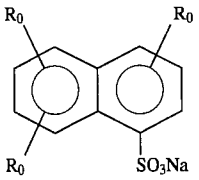

wherein $R_0$ represents

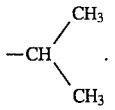

The anionic surface active agent of the present invention is added in an amount of from 0.1 to 10.0 wt % based on the dispersoid (e.g., coupler, oil, solvent).

The hydrophobic, photographically useful compound which can be used in the present invention means any organic and inorganic compounds useful in photography, and is selected from the group consisting of dye-forming couplers, ultraviolet radiation absorbing materials, reducing agent developing agents, optical brightener, development inhibition releasing couplers, absorber filter dyes, and mixture thereof. In the present invention, oil-soluble organic photographic materials are preferably used. The term "oil-soluble" material as used herein means those which dissolve in an organic solvent in an amount of 3 wt % or more at a room temperature (20° C.). The organic solvent means organic solvents as described in *Yozai (Solvent) Handbook* and examples thereof include methanol, ethanol, isopropanol, butanol, ethyl acetate, isopropyl acetate, butyl acetate, acetone, methyl ethyl ketone, tetrahydrofuran, cyclohexanone, benzene, toluene, dioxane, acetonitrile, dichloromethane and chloroform.

The hydrophobic, photographically useful compound which can be used in the dispersion of the present invention include a dye image-forming coupler, a dye image-providing redox compound, a stain inhibitor, an antifoggant, an ultraviolet light absorbent, a discoloration inhibitor, a color mixing inhibitor, a nucleating agent, a dye image stabilizer, a silver halide solvent, a bleaching accelerator, a dye for filter or a precursor thereof, a dyestuff, a pigment, a sensitizer, a hardening agent, a brightener, a desensitizer, a developing agent, an antistatic agent, an antioxidant, a developer scavenger, a mordant, and an oil or polymer for dispersion used as a medium for dispersing these compounds and examples of the compounds include those described in *Research Disclosure*, Nos. 17643, 18716 and 307105.

The hydrophobic, photographically useful compound which can be used in the dispersion of the present invention will be described below in greater detail.

a) Dye Image-forming Coupler

A compound which forms a colored or colorless dye upon coupling with the oxidation product of an aromatic primary amine developing agent is called coupler. Useful couplers are yellow, magenta, cyan and black couplers.

A representative example of the yellow coupler which can be used in the present invention is an oil-protected acylacetamido-based coupler. Specific examples thereof are described in U.S. Pat. Nos. 2,407,210, 2,875,057 and 3,265,506. Representative examples of the two-equivalent yellow coupler include oxygen atom-releasing yellow couplers described in U.S. Pat. Nos. 3,408,194, 3,447,928, 3,933,501 and 4,022,620 and nitrogen atom-releasing yellow couplers described in JP-B-58-10739 (the term "JP-B" as used herein means an "examined Japanese patent publication"), U.S. Pat. Nos. 4,401,752 and 4,326,024, *Research Disclosure* No. 18053 (April, 1979), U.S. Pat. No. 1,425,020 and West German Patent (OLS) Nos. 2,219,917, 2,261,361, 2,329,587 and 2,433,812. The α-pivaloylacetanilide coupler is excellent in fastness, in particular, light fastness of the colored dye and the α-benzoylacetanilide coupler can provide a high color density.

Among these, preferred are those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and European Patent 249,473A.

The magenta coupler which can be used in the present invention includes oil-protected indazolone couplers and cyanoacetol couplers (preferably 5-pyrazolone couplers and pyrazoloazole couplers, e.g., pyrazolotriazoles). The 5-pyrazolone coupler is preferably a coupler of which 3-position is substituted by an arylamino group or an acylamino group in view of color hue or color density of the colored dye and representative examples thereof are described in U.S. Pat. Nos. 2,311,082, 2,343,703, 2,600,788, 2,908,573, 3,062,653, 3,152,896 and 3,936,015. The leaving group of the two-equivalent 5-pyrazolone coupler is preferably a nitrogen atom-releasing group described in U.S. Pat. No. 4,310,619 or an arylthio group described in U.S. Pat. No. 4,351,897. The 5-pyrazolone coupler having a ballast group described in European Patent 73,636 can provide a high color density.

Examples of the pyrazoloazole coupler include pyrazolobenzimidazoles described in U.S. Pat. No. 3,369,879, pyrazolo[5,1-c][1,2,4]triazoles described in U.S. Pat. No. 3,725,067 and pyrazolopyrazoles described in *Research Disclosure*, No. 24220 (June, 1984). In view of lowness in the yellow sub-absorption of colored dye and light fading, imidazo[1,2-b]pyrazoles described in European Patent 119,741 and pyrazolo[1,5-b][1,2,4]triazoles described in European Patent 119,860 are preferred.

Among these, more preferred are those described in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, JP-A-61-72238, JP-A60-35730, JP-A-55-118034, JP-A-60-185951, U.S. Pat. Nos. 4,500,630, 4,540,654 and 4, 556 630 and International Patent WO88/04795.

The cyan coupler which can be used in the present invention includes oil-protected naphthol and phenol couplers. Examples of the naphthol coupler include naphthol couplers described in U.S. Pat. No. 2,474,293 and preferred are oxygen atom-releasing two-equivalent naphthol couplers described in U.S. Pat. Nos. 4,052,212, 4,146,396, 4,228,233 and 4,296,200. Specific examples of the phenol coupler are described in U.S. Pat. Nos. 2,369,929, 2,801,171, 2,772,162 and 2,895,826. Cyan couplers fast to humidity and temperature are preferably used in the present invention and typical examples thereof include phenol cyan couplers containing an alkyl group having carbon atoms greater than the ethyl group at the meta-position of the phenol nucleus described in U.S. Pat. No. 3,772,002, 2,5-diacylamino-substituted phenol couplers described in U.S. Pat. Nos. 2,772,162, 3,758,308, 4,126,396, 4,334,011 and 4,327,173, West German Patent (OLS) No. 3,329,729 and JP-A-59-166956 and phenol couplers having a phenylureido group at the 2-position and an acylamino group at the 5-position described in U.S. Pat. Nos. 3,446,662, 4,333,999, 4,451,559 and 4,427,767.

Naphthol couplers of which 5-position is substituted by a sulfonamido group or an amido group described in JP-A60-

237448, JP-A-61-153640 and JP-A-61-14557 are preferred because fastness of the colored dye image is particularly excellent. Also, pyrazoloazole couplers described in JP-A-64-553, JP-A-64-554, JP-A-64-555, JP-A-64-556 and imidazole couplers described in U.S. Pat. No. 4,818,672 can be used.

Among these, more preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658.

Typical examples of the polymerized dye-forming coupler are described in U.S. Pat. Nos. 3,451,820, 4,080,211, 4,367,282, 4,409,320 and 4,576,910, British Patent 2,102,137 and European Patent 341,188A.

With respect to the coupler which provides a colored dye having an appropriate diffusibility, preferred examples thereof include those described in U.S. Pat. No. 4,366,237, British Patent 2,125,570, European Patent No. 96,570 and West German Patent (OLS) No. 3,234,533.

With respect to the colored coupler for correcting unnecessary absorption of the colored dye, preferred examples thereof include those described in *Research Disclosure*, NO. 17643, Item VII-G, ibid., No. 307105, Item VII-G, U.S. Pat. No. 4,163,670, JP-B-57-39413, U.S. Pat. Nos. 4,004,929 and 4,138,258 and British Patent 1,146,368. Also, couplers which correct unnecessary absorption of the colored dye by a fluorescent dye released upon coupling described in U.S. Pat. No. 4,774,181 and couplers having as a leaving group a dye precursor group capable of forming a dye by reacting with a developing agent described in U.S. Pat. No. 4,777,120 are preferably used.

Further, compounds which release a photographically useful residue upon coupling are also preferably used in the present invention. Preferred examples of the DIR coupler which release a development inhibitor include those described in patents cited in the above-described RD No. 17643, Item VII-F and ibid., No. 307105, Item VII-F, JP-A-57-151944, J-A57-154234, JP-A-60-184248, JP-A-63-37346, JP-A-63-37350 and U.S. Pat. Nos. 4,248,962 and 4,782,012. Furthermore, couplers which release a bleaching accelerator described in RD Nos. 11449 and 24241 and JP-A-61-201247 are effective for reducing the processing time having a bleaching ability and in particular, in the case when they are added to a photographic material using tabular silver halide grains described above, the effect is outstanding. With respect to the coupler which imagewise release a nucleating agent or a development accelerator at the development, preferred examples thereof include those described in British Patents 2,097,140 and 2,131,188, JP-A-59-157638 and JP-A-59-170840. Also, compounds which release a fogging agent, a development accelerator or a silver halide solvent upon redox reaction with the oxidation product of a developing agent described in JP-A-61-107029, JP-A-60-252340, JP-A-1-44940 and JP-A-1-45687 are preferred.

Other couplers which can be used as the hydrophobic, photographically useful compound of the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A-60-185950 and JP-A-62-24252, couplers which release a dye capable of recovering the color after the release described in European Patents 173,302A and 313,308A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

These couplers can be used in the same layer in combination of two or more thereof so as to satisfy the required characteristics of the photographic material.

b) Dye Image-providing Redox Compound

Another example of the hydrophobic compound which can be used in the present invention is a dye image-providing redox compound used in a photographic material for color diffusion transfer method. As is well known in the art, the compound may be negative-type or positive-type and when processed with an alkaline processing composition, it may be initially movable or immovable in the photographic element.

An example of the negative-type dye image-providing compound for use in the present invention is a coupler which forms or releases a dye by reacting with the oxidized color developing agent and specific examples thereof include those described in U.S. Pat. No. 3,227,550 and Canadian Patent 602,207.

An example of the negative-type dye image-providing compound preferred for use in the present invention is a dye-releasing redox compound which releases a dye by reacting with a developing agent in the oxidized state or with an electron-transfer agent, and representative and specific examples thereof are described in JP-A-48-33826, JP-A-51-113624, JP-A-54-54021 and JP-A-56-71072. The immovable negative-type dye image-providing compound which can be used in the present invention includes a compound which releases a diffusible dye without accepting any electrons (namely, without being reduced) or after accepting at least one electron (namely after being reduced), during photographic processing in alkaline conditions.

Further, an example of the positive-type dye image-providing compound initially movable under alkaline photographic processing conditions is a dye developing agent. Representative and specific examples thereof include those described in JP-B-48-32130 and JP-B-55-22780.

The dye formed from a dye image-providing compound used in the present invention may be a preformed dye or a dye precursor capable of converting into a dye during photographic processing or additional processing and the final image dye may be either metallized or not. Representative examples of the dyestuff useful in the present invention include metallized or not metallized dyes of an azo dye, an azomethine dye, an anthraquinone dye or a phthalocyanine dye. Among these, more important are azo-type cyan, magenta and yellow dyes.

c) Ultraviolet Absorbent

Examples of the ultraviolet absorbent for use in the present invention include those described in JP-B-42-21687, JP-B-48-5496, JP-A-47-1026 and British Patent 1,293,982. Among these, more preferred are oil-soluble ultraviolet absorbents.

d) Organic or Inorganic Dyestuff or Pigment

Examples of the dyestuff or the pigment for use in the present invention include organic or inorganic dyestuffs or pigments such as an azo dyestuff or pigment, an azomethine dyestuff or pigment, an oxonol dyestuff or pigment, a cyanine dyestuff or pigment, a phthalocyanine dyestuff or pigment, a quinacridone dyestuff or pigment, an anthraquinone dyestuff or pigment, a dioxazine dyestuff or pigment, an indigo dyestuff or pigment, a perynone.perylene dyestuff or pigment, titanium oxide, a cadmium dyestuff or pigment, an iron oxide dyestuff or pigment, chromium oxide and carbon black, and also, other known dyes conventionally used as a coloring agent or a mixture of these may be used. The dyestuff or pigment of the present invention may be in the form either of an aqueous paste immediately after the production or of powder. In particular, the present invention is useful for the dispersion of an oil-soluble dyestuff described in U.S. Pat. No. 4,420,555, JP-A-61-204630 and JP-A-61-205934.

The oil-soluble dyestuff particularly useful in the present invention will be described below.

The particularly useful dyestuff for use in the present invention may be any of various known dyestuffs. The dyestuff may have a structure such as an arylidene compound, a heterocyclic arylidene compound, anthraquinones, triarylmethanes, an azomethine dye, an azo dye, cyanine, merocyanine, oxonol, a styryl dye, phthalocyanine, indigo or the like. The dyestuff used in the present invention is insoluble in water and preferably has a solubility in ethyl acetate of 10 g/l or more (at 40° C.) but the structure of chromophore is not important.

The arylidene compound is a compound where an acidic nucleus and an aryl group are linked through one methine group or a plurality of methine groups.

Examples of the acidic nucleus include 2-pyrazolin-5-one, 2-isooxazolin-5-one, barbituric acid, 2-thiobarbituric acid, benzoylacetonitrile, cyanoacetamide, cyanoacetanilide, cyanoacetic ester, malonic ester, malondianilide, dimedone, benzoylacetanilide, pivaloylacetanilide, malononitrile, 1,2-dihydro-6-hydroxypyridin-2-one, pyrazolidin-3,5-dione, pyrazolo[3,4-b]pyridin-3,6-dione, indan-1,3-dione, hydantoin, thiohydantoin and 2,5-dihydrofuran-2-one.

An example of the aryl group is a phenyl group which is preferably substituted by an electron-donating group such as an alkoxy group, a hydroxy group or an amino group.

The heterocyclic arylidene compound is a compound where an acidic nucleus and a heteroaromatic ring are linked through one methine group or a plurality of methine groups.

Examples of the acidic nucleus include those described above.

Examples of the heteroaromatic ring include pyrrole, indole, furan, thiophene, pyrazole and coumarin.

The anthraquinones are those where an anthraquinone is substituted by an electron-donating group or an electron-attractive group.

The triarylmethanes are compounds where one methine group is bonded by three substituted aryl groups (which may be the same or different) and an example thereof is phenolphthalein.

The azomethine dye is a compound where an acidic nucleus and an aryl group are linked through an unsaturated nitrogen linking group (an azomethine group). Examples of the acidic nucleus include those described above and in addition, those known as photographic couplers. The indoanilines belong to the azomethine dye.

The azo dye is a compound where an aryl group or a heteroaromatic ring group is linked by an azo group.

The cyanine is a compound where two basic nuclei are linked through one methine group or a plurality of methine groups. Examples of the basic nucleus include pyrylium and quaternary salts such as oxazole, benzoxazole, thiazole, benzothiazole, benzimidazole, quinoline, pyridine, indolenine, benzoindolenine, benzoselenazole and imidazoquinoxaline.

The merocyanine dye is a compound where the above-described basic nucleus and an acidic nucleus are linked through a double bond or one or more methine groups.

The oxonol dye is a compound where two acidic nuclei described above are linked through one or three or more odd number of methine groups.

The styryl dye is a compound where the above-described basic nucleus and an aryl group are linked through two or four methine groups.

The phthalocyanine may be or may not be coordinated to a metal atom.

The indigo may be either an unsubstituted indigo or a substituted indigo and includes thioindigo.

e) Other Hydrophobic Compound

Other hydrophobic compound which can be used in the present invention is an electron donor (hereinafter referred to as "ED") capable of giving at least one electron to an oxidation type dye-providing compound or an oxidation product of a color developing agent. An example of effective EDs is a compound having a Kendall-Pliz partial structure as described in T. H. James, *The Theory of the Photographic Process*, 4th edition, Chapter 11. Examples of the compound classified into this group include hydroquinones, catechols, o-aminophenols and p-aminophenols. The ED compound for use in the present invention is preferably low-diffusible when incorporated into a photographic material layer. Low-diffusible or non-diffusible hydroquinones and pyrogallols are widely used as color mixing inhibitor, antioxidant or discoloration inhibitor. Specific examples of these compounds include 2,5-di-n-octylhydroquinone, 2,5-di-t-pentadecylhydroquinone, n-dodecyl ester of gallic acid and p-laurylamidopyrogallol.

The ED precursor which can be used in the present invention is a compound suitable for use in combination with a positive type dye image-providing compound and examples thereof include saccharin compounds as described in U.S. Pat. No. 4,263,393 and active methine compounds as described in U.S. Pat. No. 4,278,750.

Examples of other materials which can be used in the present invention as a hydrophobic compound include an antifoggant and a development inhibitor, represented by mercaptotetrazoles, mercaptotriazoles, mercaptopyrimidines, mercaptobenzimidazoles, mercaptothiadiazoles, benzotriazoles and imidazoles; a developing agent such as p-phenylenediamines, hydroquinones and p-aminophenols; an auxiliary developing agent represented by pyrazolidones; a nucleating agent such as hydrazines and hydrazides; a silver halide solvent such as hypo; a bleaching accelerator such as aminoalkylthiols; and dyes such as an azo dye and an azomethine dye. Also, hydrophobic compounds further having a redox function of releasing a precursor of the above-described hydrophobic compound or releasing a hydrophobic compound described above as the development proceeds, for example, in addition to the above-described dye materials for a color diffusion transfer photographic material, DIR-hydroquinones and DAR-hydroquinones can be a good hydrophobic compound. The above-described hydrophobic compound may be bonded through a timing group. Examples of the timing group include those which release a photographically useful material upon intramolecular cyclization described in JP-A-4-145135, those which release a photographically useful material upon intramolecular electron transfer described in British Patent 2,072,363 and JP-A-57-154234, those which release a photographically useful material accompanied by desorption of carbon dioxide gas described in JP-A-57-179842, and those which releases a photographically useful material accompanied by desorption of formalin described in JP-A-59-93442.

The disperser used for practicing the present invention includes a high-speed agitation-type disperser having large shearing force and a disperser which gives highly intensified ultrasonic energy. Specific examples thereof include a colloid mill, a homogenizer, a capillary emulsifier, a liquid siren, an electromagnetic strain type ultrasonic generator and an emulsifier with Pullman's whistle. The high-speed agitation-type disperser used in the present invention is preferably a disperser of which main part to effect dispersion operation is rotated at a high speed in the solution (at from 500 to 15,000 rpm, preferably from 2,000 to 4,000 rpm), such as dissolver, POLYTRON, homomixer, homoblender, Keddy mill or jet agitator. The high-speed agitation-type disperser for use in the present invention is called a dissolver or a high-speed impeller disperser and in one more preferred embodiment, an impeller comprising saw tooth blades folded alternately upward and downward is installed to the shaft which rotates at a high speed as described in JP-A-55-129136.

In preparing a dispersion containing the hydrophobic compound according to the present invention, various processes may be followed. In the case where the hydrophobic compound is dissolved in an organic solvent, it is dissolved in a single solvent or a mixed solvent comprising plurality of ingredients, freely selected from high boiling point organic materials, water-immiscible low boiling point organic solvents and water miscible organic solvents, which will be described below, and then dispersed in water or an aqueous hydrophilic colloid solution in the presence of the surface active compound represented by formula (I) of the present invention. In this case, the surface active compound of the present invention is present together in at least one of solutions, water or an aqueous hydrophilic colloid, or solution containing the hydrophobic compound.

An oily solution containing the hydrophobic compound and an aqueous solution may be mixed by so-called forward mixing where an oily solution is added to an aqueous solution while stirring or by reverse mixing reversal thereto, but they are particularly preferably mixed by phase inversion method as one of reverse mixing methods so as to provide a finer aqueous dispersion.

In the present invention, the hydrophobic compound can be dispersed stably in either water or a hydrophilic colloid composition, but is preferably dispersed in a hydrophilic colloid composition.

The hydrophilic colloid in the hydrophilic colloid composition for use in the present invention is a binder or protective colloid commonly used for silver halide photographic materials.

Gelatin is advantageously used as the binder or protective colloid for a photographic emulsion, but other hydrophilic colloids may also be used. Examples thereof include gelatin derivatives, graft polymers of gelatin with other polymers, proteins such as albumin and casein, cellulose derivatives such as hydroxyethyl cellulose, carboxymethyl cellulose and cellulose sulfuric esters, saccharide derivatives such as sodium alginate and starch derivatives, and various kinds of synthetic hydrophilic polymer materials, namely, homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

The gelatin may be lime-processed gelatin or acid-processed gelatin and also a gelatin hydrolysate or a gelatin enzyme dispersion may be used. The gelatin derivative may be obtained by reacting gelatin with various compounds such as acid halide, acid anhydride, isocyanates, bromoacetic acid, alkanesultones, vinylsulfonamides, maleinimide compounds, polyalkylene oxides or epoxy compounds.

When an oil-soluble dyestuff is used as a filter dye or an antihalation dye, it may be used in any effective amount but preferably used in such an amount as to give an optical density of from 0.05 to 3.5. It may be added at any time before coating.

The specific amount of the dyestuff varies depending upon the dyestuff, the dispersion polymer or the dispersion method, but in general, it is preferably from $10^{-3}$ to 3.0 g/m$^2$, more preferably from $10^{-3}$ to 1.0 g/m$^2$.

Examples of the high boiling point solvent used in an oil-in-water dispersion are described in U.S. Pat. No. 2,322,027 and International Patent WO91/17480, and specific examples of the high boiling point organic solvent having a boiling point at normal pressure of 175° C. or higher include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic esters (2-ethylhexylbenzoate, dodecylbenzoate, 2-ethylhexyl-p-hydroxybenzoate), amides (e.g., N,N-diethyldecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline) and hydrocarbons (e.g., paraffin, dodecylbenzene, diisopropylnaphthalene).

A method where fine dispersion is conducted by increasing the amount of the surface active agent and then an excess of the surface active agent is removed by water washing as described in International Patent WO93/3420 is also effective.

The auxiliary solvent or the surface active agent can be removed by known methods and examples of the method include those described in U.S. Pat. Nos. 2,322,027, 2,801,171, 2,946,360, 3,396,027 and 4,233,397.

In the present invention, in order to dissolve the hydrophobic, photographically useful compound, a water-immiscible low boiling point organic solvent (which has a boiling point of 130° C. or lower at 1 atm) or a water-miscible organic solvent may be used in addition to the above-described high boiling point organic solvent. Further, the water-immiscible or water-miscible organic solvents may then be removed from the system by distillation, more preferably distillation under reduced pressure, rinsing or ultrafiltration, or other known method, to increase the stability of the obtained dispersion. Examples of these organic solvents include, propylene carbonate, methyl acetate, ethyl acetate, isopropyl acetate, butyl acetate, ethyl propionate, sec-butyl alcohol, methyl ethyl ketone, 2-pentanone, 3-pentanone, cyclohexanone, dimethylformamide, and dimethyl sulfoxide. The amount added of the organic solvents is preferably 0.1 to 100 times the weight of the hydrophobic compound to be dispersed.

The hydrophobic, photographically useful material can be precipitation-dispersed by dissolving the material in an alkaline solution, a water-miscible organic solvent or a mixture of these and then neutralizing it in the presence of the surface active agent of the present invention or mixing it with water. The material can be dispersed by adding the surface active agent of the present invention to the solution and directly adding to the coating solution.

Representative examples of the dispersion according to this method are described in British Patent 1,193,349 and U.S. Pat. Nos. 4,957,857 and 4,933,270 where it is applied to a photographic color coupler and in JP-A-4-163453 where it is applied to other hydrophobic, photographically useful material.

The solid hydrophobic, photographically useful material can be formed directly into a fine solid dispersion in the presence of water and the surface active agent of the present invention by medium dispersion.

A representative example thereof is solid dispersion of a dye described in International Patent WO88/04794. It is also effective to apply it to a pigment such as carbon black or titanium oxide.

The medium dispersion is commonly conducted by mechanical dispersion using a ball mill, a sand grinder mill or a colloid mill.

The surface active agent of the present invention can be also used as an emulsifier in synthesizing an aqueous polymer latex by emulsion-polymerization, and the polymer latex produced can be incorporated as it is into a photographic material, or the polymer latex produced can be charged with a hydrophobic, photographically useful material and then incorporated into a photographic material.

The dispersion method using a polymer latex is described in U.S. Pat. No. 4,199,363, West German Patent (OLS) Nos. 2,541,274 and 2,541,230.

As described in detail in the foregoing, according to the present invention, dispersed particles of a hydrophobic, photographically useful compound can be stably obtained and aging stability can be provided over a wide range of temperature to the compound either in the liquid state or the gel state, whereby a great improvement in preparation aptitude can be achieved. Also, by using two kinds of surface active compounds to exercise. separate functions, namely fine granulation at the dispersion and stabilization at the completion of dispersion, the characteristics of each compound can be exerted to the maximum extent and as a result, the dispersion can have a particle size preferred at the use.

The present invention will be described below in greater detail by referring to the examples, but the present invention should not be construed as being limited thereto.

EXAMPLE 1

Emulsified Products A-1 to A-8 were prepared by using the following Solutions I-1 and II-1 to II-8 according to the method described below.

| | |
|---|---|
| Solution I-1 | |
| Lime-processed gelatin solution (10%) | 1,000 g |
| Solution II-1 (A-1) | |
| Coupler (C-1) shown below | 100 g |
| Tricresyl phosphate | 50 g |
| Ethyl acetate | 150 g |
| Sodium dodecylbenzenesulfonate (S-9) | 10 g |
| Solution II-2 (A-2) | |
| Coupler (C-1) shown below | 100 g |
| Tricresyl phosphate | 50 g |
| Ethyl acetate | 150 g |
| Sodium dodecylbenzenesulfonate (S-9) | 5 g |
| PW-3 | 5 g |
| Solution II-3 (A-3) | |
| Coupler (C-1) shown below | 100 g |

-continued

| | |
|---|---|
| Tricresyl phosphate | 50 g |
| Ethyl acetate | 150 g |
| Sodium dodecylbenzenesulfonate (S-9) | 5 g |
| PW-17 | 5 g |
| Solution II-4 (A-4) | |
| Coupler (C-1) shown below | 100 g |
| Tricresyl phosphate | 50 g |
| Ethyl acetate | 150 g |
| Sodium dodecylbenzenesulfonate (S-9) | 5 g |
| PW-4 | 5 g |
| Solution II-5 (A-5) | |
| Coupler (C-1) shown below | 100 g |
| Tricresyl phosphate | 50 g |
| Ethyl acetate | 150 g |
| Sodium bis(2-ethylhexyl)sulfosuccinate (S-8) | 10 g |
| Solution II-6 (A-6) | |
| Coupler (C-1) shown below | 100 g |
| Tricresyl phosphate | 50 g |
| Ethyl acetate | 150 g |
| Sodium bis(2-ethylhexyl)sulfosuccinate (S-8) | 5 g |
| PW-3 | 5 g |
| Solution II-7 (A-7) | |
| Coupler (C-1) shown below | 100 g |
| Tricresyl phosphate | 50 g |
| Ethyl acetate | 150 g |
| Sodium bis(2-ethylhexyl)sulfosuccinate (S-8) | 5 g |
| PW-17 | 5 g |
| Solution II-8 (A-8) | |
| Coupler (C-1) shown below | 100 g |
| Tricresyl phosphate | 50 g |
| Ethyl acetate | 150 g |
| Sodium bis(2-ethylhexyl)sulfosuccinate (S-8) | 5 g |
| PW-4 | 5 g |

C-1:

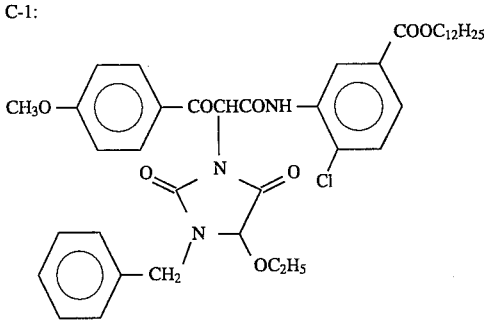

Emulsification was conducted in such a way that Solution I and Solution II were mixed and dissolved at 60° C. and then stirred in a 2-l container using a dissolver impeller having a diameter of 5 cm at a rotation number of 5,000 rpm for 20 to 30 minutes to give an average particle size of about 0.15 μm. The average particle size was determined by means of NICOMP Model 370 manufactured by Nosaki Sangyo KK using dynamic light scattering.

Each of eight kinds of emulsified products prepared above was examined on the change in particle size when it was allowed to stand at 40° C. in the state of solution or when it was cooled to gel and stored at 5° C. for a long period of time.

The results obtained are shown in Table 1.

TABLE 1

| Emulsified Product | Average Grain Size (μm) | | | | | |
|---|---|---|---|---|---|---|
| | Immediately after preparation | After storage at 40° C. for 12 hours | After storage at 40° C. for 24 hours | After storage at 5° C. for 2 days | After storage at 5° C. for 10 days | After storage at 5° C. for 20 days |
| A-1 (Comparison) | 0.15 | 0.28 | 0.34 | 0.16 | 0.17 | 0.20 |
| A-2 (Invention) | 0.15 | 0.19 | 0.20 | 0.15 | 0.18 | 0.18 |
| A-3 (Invention) | 0.15 | 0.15 | 0.16 | 0.15 | 0.15 | 0.16 |
| A-4 (Invention) | 0.16 | 0.18 | 0.18 | 0.15 | 0.15 | 0.16 |
| A-5 (Comparison) | 0.14 | 0.31 | 0.38 | 0.19 | 0.22 | 0.24 |
| A-6 (Invention) | 0.15 | 0.19 | 0.21 | 0.15 | 0.16 | 0.19 |
| A-7 (Invention) | 0.15 | 0.18 | 0.18 | 0.15 | 0.16 | 0.17 |
| A-8 (Invention) | 0.14 | 0.18 | 0.20 | 0.15 | 0.15 | 0.16 |

As seen from Table 1, Emulsified Products A-1 and A-5 for comparison underwent conspicuous growth of particles when they were stored at 40° C., whereas Emulsified Products A-2 to A-4 and A-6 to A-8 according to the present invention, the particles showed only a modicum of growth over a long period of time. Accordingly, it is proved that the stability in particle size can be achieved by the present invention.

EXAMPLE 2

Emulsified Products B-1 to B-3 were prepared using the following Solutions I-2, and II-9 to II-11 according to the method described below.

| | |
|---|---|
| Solution I-2 | |
| Lime-processed gelatin solution (20%) | 500 g |
| Solution II-9 (B-1) | |
| Coupler (C-2) shown below | 100 g |
| Tricresyl phosphate | 50 g |
| Ethyl acetate | 100 g |
| Sodium dodecylbenzenesulfonate (S-9) | 10 g |
| Solution II-10 (B-2) | |
| Coupler (C-2) shown below | 100 g |
| Tricresyl phosphate | 50 g |
| Ethyl acetate | 100 g |
| Sodium dodecylbenzenesulfonate (S-9) | 7 g |
| PW-4 | 3 g |
| Solution II-11 (B-3) | |
| Coupler (C-2) shown below | 100 g |
| Tricresyl phosphate | 50 g |
| Ethyl acetate | 100 g |
| Sodium dodecylbenzenesulfonate (S-9) | 7 g |

-continued

C-2:

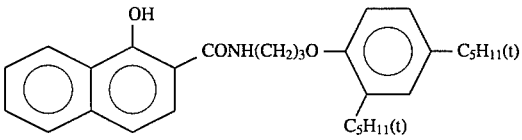

Emulsification was conducted in such a way that Solution I and Solution II were mixed and dissolved at 60° C. and then stirred in a 2-l container using a dissolver impeller having a diameter of 5 cm at a rotation number of 6,000 rpm for 30 minutes. Immediately thereafter, the rotation number was reduced to 1,000 rpm and 500 g of ion-exchanged water was added to Emulsified Products B-1 and B-2 and 500 g of a 0.6 wt % solution of Surface Active Agent PW-4 was added to Emulsified Products B-3, and then each emulsified product was subjected to mixing for 1 minute.

The average particle size was determined in the same manner as in Example 1, and tile evaluation on coarse particles was conducted in such a manner that 1 g of each emulsified product was coated on a polyethylene terephthalate film and dried, and then particles of 20 μm or more were counted through an optical microscope.

Each of three kinds of emulsified products prepared above was examined on the change in particle size when it was allowed to stand at 40° C. in the state of solution and on the change in number of coarse particles of 20 μm or more.

The results obtained are shown in Table 2.

TABLE 2

| Emulsified Product | Average Grain Size (μm) | | | Number of Coarse Grains (piece/l g) | | |
|---|---|---|---|---|---|---|
| | Immediately after preparation | After storage at 40° C. for 12 hours | After storage at 40° C. for 24 hours | Immediately after preparation | After storage at 40° C. for 12 hours | After storage at 40° C. for 24 hours |
| B-1 (Comparison) | 0.08 | 0.16 | 0.19 | 6 | 72 | 108 |
| B-2 (Invention) | 0.10 | 0.12 | 0.12 | 1 | 3 | 2 |
| B-3 (Invention) | 0.08 | 0.10 | 0.10 | 2 | 2 | 2 |

As is seen from Table 2, the average particle size immediately after the preparation was slightly increased in the case of Emulsified Product B-2 where PW-4 was previously added. It is assumed that since the molecular weight of PW-4 is high (553) as compared with the molecular weight of sodium dodecylbenzenesulfonate which is 348, the dispersability is reduced. However, as is clearly understood from Table 2, even when a surface active material having such a large molecular weight is used, if it is added separately after the completion of dispersion as a stabilizer as seen in Emulsified Product B-3, fine particles can be obtained, and also the change in particle size by aging as well as the generation of coarse particles by aging can be inhibited.

EXAMPLE 3

Emulsified Product B-4 was prepared in the same manner as Emulsified Product B-3 in Example 2 except that none was added at the completion of dispersion, and the emulsified product in a thick state was allowed to stand at 40° C. for 6 hours. Thereafter, 500 g of a 0.6 wt % solution of Surface Active Agent PW-4 was added thereto and mixed at a rotation number of 1,000 rpm for 1 minute. Then, the mixture was aged at 40° C. for the time period of from 12 to 24 hours, and the average grain size was traced. The particle size was measured in the same manner as in Example 1.

The results obtained are shown in Table 3.

TABLE 3

| | Average Grain Size (μm) | | | |
|---|---|---|---|---|
| Emulsified Product | Immediately after preparation | After storage at 40° C. for 6 hours | After storage at 40° C. for 12 hours | After storage at 40° C. for 24 hours |
| B-4 | 0.09 | 0.18 | 0.20 | 0.21 |

As is seen from Table 3, the growth of particles was conspicuous after aging for 6 hours but after 12-hour aging and after 24-hour aging where Surface Active Agent PW-4 of the present invention was added, tile particle size underwent almost no change. Accordingly, it is confirmed that, irrespective of the history of dispersion after the preparation, excellent aging stability can be provided by adding the surface active agent represented by formula (I) of the present invention at any stage after the preparation of dispersion.

While the invention has been described in detail and with reference to specific embodiments thereof, it will be apparent to one skilled in the art that various changes and modifications can be made therein without departing from the spirit and scope thereof.

What is claimed is:

1. A method for dispersing a water-insoluble phase containing at least one hydrophobic, photographically useful compound in water or a hydrophilic colloid composition with an anionic surface active agent, which comprises dispersing said at least one hydrophobic, photographically useful compound in water or a hydrophilic colloid composition in the presence of an anionic surface active agent containing a hydrophobic group having from 8 to 30 carbon atoms and a group represented by $—SO_3M$ or $—OSO_3M$ (where M represents a cation capable of forming a salt with a sulfonic acid or a sulfuric acid) and a surface active compound represented by formula (I):

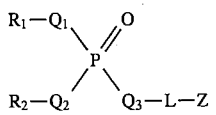

(I)

wherein $R_1$ represents an aliphatic group, an alicyclic compound group, an aromatic group or a heterocyclic ring, $R_2$ represents an aliphatic group, an alicyclic compound group, an aromatic group, a heterocyclic ring or a group represented by —L—Z, $Q_1$, $Q_2$ and $Q_3$ each represents a mere bond, an oxygen atom, a sulfur atom or a group represented by $—N(R_3)—$ or $—N(R_3)—CO—$ (where $R_3$ represents a hydrogen atom or a group represented by $R_2$), L represents a divalent linking group and Z represents an ionic group, to form a dispersion of the water-insoluble phase containing a hydrophobic, photographically useful compound in water or a hydrophobic colloid composition.

2. A method for dispersing a water-insoluble phase containing at least one hydrophobic, photographically useful compound in water or a hydrophilic colloid composition with an anionic surface active agent, which comprises the steps of:

adding an anionic surface active agent containing a hydrophobic group having from 8 to 30 carbon atoms and a group represented by $—SO_3M$ or $—OSO_3M$ (where M represents a cation capable of forming a salt with a sulfonic acid or a sulfuric acid) to either of said water-insoluble phase or said water or hydrophilic colloid composition;

mixing and dispersing the at least one hydrophobic, photographically useful compound therein to form a dispersed system; and then adding a surface active compound represented by formula (I) to the dispersed system,

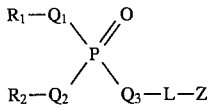

(I)

wherein $R_1$ represents an aliphatic group, an alicyclic compound group, an aromatic group or a heterocyclic ring, $R_2$ represents an aliphatic group, an alicyclic compound group, an aromatic group, a heterocyclic ring or a group represented by —L—Z, $Q_1$, $Q_2$ and $Q_3$ each represents a single bond, an oxygen atom, a sulfur atom or a group represented by $—N(R_3)—$ or $—N(R_3)—CO—$ (where $R_3$ represents a hydrogen atom or a group represented by $R_2$), L represents a divalent linking group and Z represents an ionic group, to form a dispersion of the water-insoluble phase containing a hydrophobic, photographically useful compound in water or a hydrophobic colloid composition.

3. A method as described in claim 1, where the amount of said surface active compound represented by formula (I) is from 0.1 to 10% by weight based on the weight of the at least one photographically useful compound.

4. A method as described in claim 1, where the surface active compound represented by formula (I) is selected from the following:

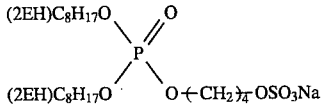

PW-3

-continued

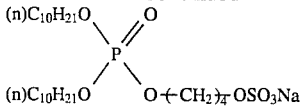

PW-4

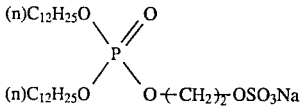

PW-5

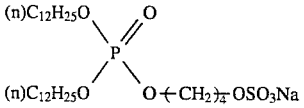

PW-6

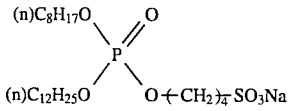

PW-17

5. A method as described in claim 1, where said at least one photographically useful compound is selected from the group consisting of a dye-forming coupler compound, an ultraviolet radiation absorbing compound, a developing agent compound, an optical brightener compound, a development inhibition releasing coupler compound, an absorber filter dye compound, and a mixture thereof.

6. A method as described in claim 1, where said anionic surface active agent is selected from the following:

$C_{12}H_{25}OSO_3Na$ (S-1)
$C_{12}H_{25}SO_3Na$ (S-5)
(S-7)

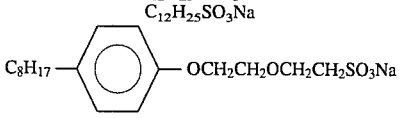

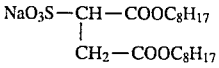

(S-8)

(S-9)

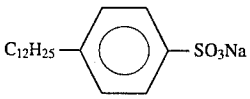

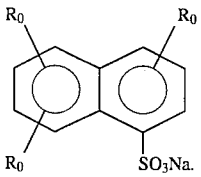

(S-11)

7. A method as described in claim 2, where the amount of said surface active compound represented by formula (I) is from 0.1 to 10% by weight based on the weight of the at least one photographically useful compound.

8. A method as described in claim 2, where the surface active compound represented by formula (I) is selected from the following:

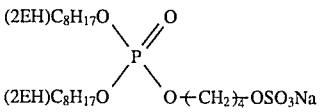

PW-3

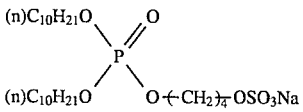

PW-4

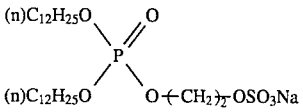

PW-5

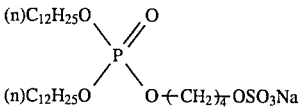

PW-6

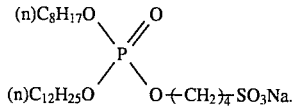

PW-17

9. A method as described in claim 2, where said at least one photographically useful compound is selected from the group consisting of a dye-forming coupler compound, an ultraviolet radiation absorbing compound, a developing agent compound, an optical brightener compound, a development inhibition releasing coupler compound, an absorber filter dye compound, and a mixture thereof.

10. A method as described in claim 2, where said anionic surface active agent is selected from the following:

$C_{12}H_{25}OSO_3Na$ (S-1)
$C_{12}H_{25}SO_3Na$ (S-5)
(S-7)

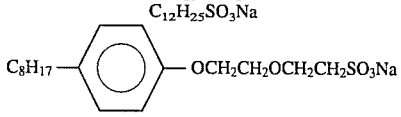

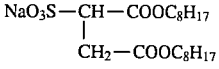

(S-8)

(S-9)

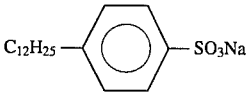

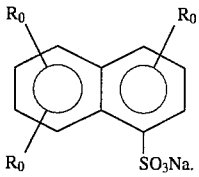

(S-11)

* * * * *